US007087355B2

(12) United States Patent
Fields et al.

(10) Patent No.: US 7,087,355 B2
(45) Date of Patent: Aug. 8, 2006

(54) ELECTROPHOTOGRAPHIC TONER CONTAINING POLYALKYLENE WAX OR HIGH CRYSTALLINITY WAX

(75) Inventors: Robert D. Fields, Rochester, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/083,726

(22) Filed: Mar. 18, 2005

(65) Prior Publication Data

US 2005/0164111 A1 Jul. 28, 2005

Related U.S. Application Data

(63) Continuation of application No. 10/232,128, filed on Aug. 30, 2002, now abandoned.

(60) Provisional application No. 60/317,289, filed on Sep. 5, 2001.

(51) Int. Cl.
*G03G 9/08* (2006.01)

(52) U.S. Cl. ..... 430/108.8; 430/109.3; 430/122

(58) Field of Classification Search ..... 430/108.8, 430/108.1, 109.3, 122
See application file for complete search history.

(56) References Cited

U.S. PATENT DOCUMENTS

| | | | | |
|---|---|---|---|---|
| 2,229,513 | A | 1/1941 | Lustig et al. | |
| 3,716,630 | A | 2/1973 | Shirk | |
| 3,893,935 | A | 7/1975 | Jadwin et al. | |
| 3,938,992 | A | 2/1976 | Jadwin et al. | |
| 3,941,898 | A | 3/1976 | Sadamatsu et al. | |
| 4,076,857 | A | 2/1978 | Kasper et al. | |
| 4,079,014 | A | 3/1978 | Burness et al. | |
| 4,160,644 | A | 7/1979 | Ryan | |
| 4,323,634 | A | 4/1982 | Jadwin | |
| RE31,072 | E | 11/1982 | Jadwin et al. | |
| 4,385,823 | A | 5/1983 | Kasper et al. | |
| 4,394,430 | A | 7/1983 | Jadwin et al. | |
| 4,414,152 | A | 11/1983 | Santilli et al. | |
| 4,416,965 | A | 11/1983 | Sandhu et al. | |
| 4,473,029 | A | 9/1984 | Fritz et al. | |
| 4,546,060 | A | 10/1985 | Miskinis et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,810,610 | A | 3/1989 | Grushkin et al. | |
| 4,814,250 | A | 3/1989 | Kwarta et al. | |
| 4,834,920 | A | 5/1989 | Bugner et al. | |
| 4,840,864 | A | 6/1989 | Bugner et al. | |
| 4,912,009 | A | 3/1990 | Amering et al. | |
| 5,057,392 | A | 10/1991 | McCabe et al. | |
| 5,089,547 | A | 2/1992 | McCabe et al. | |
| 5,102,755 | A | 4/1992 | Ruhland et al. | |
| 5,102,765 | A | 4/1992 | McCabe et al. | |
| 5,106,715 | A | 4/1992 | Matsumura et al. | |
| 5,112,715 | A | 5/1992 | DeMejo et al. | |
| 5,147,747 | A | 9/1992 | Wilson et al. | |
| 5,330,568 | A | 7/1994 | Park et al. | |
| 5,364,722 | A * | 11/1994 | Tanikawa et al. | 430/108.8 |
| 5,384,224 | A | 1/1995 | Tanikawa et al. | |
| 5,407,773 | A | 4/1995 | Furuta et al. | |
| 5,629,123 | A * | 5/1997 | Tomono et al. | 430/108.3 |
| 5,780,195 | A | 7/1998 | Nava | |
| 6,015,647 | A | 1/2000 | Ugai et al. | |
| 6,562,534 | B1 | 5/2003 | DeMeutter et al. | |
| 2001/0018158 | A1 | 8/2001 | Yoshida et al. | |

FOREIGN PATENT DOCUMENTS

| | | |
|---|---|---|
| EP | 003905 | 2/1979 |
| EP | 531990 B1 | 9/1992 |
| EP | 827038 B1 | 9/1997 |
| EP | 875794 A3 | 4/1998 |
| EP | 950927 A3 | 4/1999 |
| EP | 1 197806 A3 | 10/2001 |
| GB | 1 420 839 | 5/1973 |
| GB | 1 501 065 | 7/1975 |

OTHER PUBLICATIONS

Diamond, Arthur S. (ed.) Handbook of Imaging Materials. New York: Marcel-Dekker, Inc. (1991) pp. 162-170, 193-196, 210-213.*
EPO Search Report, dated Jul. 29, 2003.

* cited by examiner

*Primary Examiner*—Christopher Rodee
(74) *Attorney, Agent, or Firm*—Carl F. Ruoff

(57) ABSTRACT

Toner particles having at least one toner resin and at least one polyalkylene wax or a wax having a percent crystallinity of 80% or more are described. The wax that is present in the toner particles has a polydispersity of 2.0 or higher or a percent crystallinity of 80% or more, and also preferably has a number average molecular weight of about 2,000 or higher and/or a melting temperature onset of from about 115° C. to about 130° C. Development systems using the toner particles of the present invention are further described. Also, improvements in various properties associated with development systems are further described such as reduced toner dust levels as well as improved toner image abrasion resistance.

14 Claims, No Drawings

ELECTROPHOTOGRAPHIC TONER CONTAINING POLYALKYLENE WAX OR HIGH CRYSTALLINITY WAX

CROSS REFERENCE TO RELATED APPLICATIONS

This is a continuation of application Ser. No. 10/232,128 filed Aug. 30, 2002, now abandoned, which is a 111A application of Provisional Application No. 60/317,289 filed Sep. 5, 2001.

BACKGROUND OF THE INVENTION

The present invention relates to toners and development systems for toners.

The image quality currently available with printers and copiers is generally good in that prints have a high solid area reflection density, low background in non-image areas, and consistent print quality from toner lot to toner lot and from the start of a new developer until it is replaced. The present toners, however, are not as good with respect to such properties as toner ruboff (e.g., the abrasion resistance of the fused image). In attempting to improve toner ruboff, a wax, for instance, can be included in the toner. However, waxes can affect triboelectric properties of a toner. This problem of increased triboelectric properties is more pronounced for negatively charging toners. If the triboelectric properties are increased, the resulting prints may look gray because less toner is being transferred onto the paper. In addition, the toners may not be as free flowing as desired. Furthermore, the presence of waxes can affect the glass transition temperature of the toner formulation and also can affect the release properties of a fused image from a heated fusing roller.

Accordingly, new toner formulations which provide an improved or reduced ruboff and which further provide other properties without effecting the charge and/or flow properties would be beneficial to those in the industry.

SUMMARY OF THE PRESENT INVENTION

A feature of the present invention is to provide an electrophotographic toner having improved toner image abrasion resistance.

Another feature of the present invention is to provide a toner formulation that has the ability to reduce dusting levels in a development system and therefore reduce or eliminate image background and machine contamination.

A further feature of the present invention is to provide an electrophotographic toner formulation that reduces ruboff and yet provides satisfactory charge and/or flow properties.

Additional features and advantages of the present invention will be set forth in part in the description which follows, and in part will be apparent from the description, or may be learned by practice of the present invention. To achieve these and other advantages and in accordance with the purposes of the present invention as embodied and broadly described herein, the present invention relates to toner particles or a toner formulation containing at least one toner resin and at least one wax. The wax can be a polyalkylene wax having a polydispersity of 2.0 or higher. Alternatively or in addition, the wax can have a percent crystallinity of 80% or more as measured by DSC. The wax preferably also has a number average molecular weight of about 2,000 or higher and/or a melting temperature onset of from about 115° C. to about 130° C. The toner particles or formulations of the present invention can optionally have at least one charge control agent, at least one surface treatment agent, at least one colorant, other conventional components, or combinations thereof.

The present invention also relates to a developer containing the toner particles of the present invention.

The present invention further relates to a development system using the toner particles of the present invention.

The present invention also relates to a method of improving toner image abrasion resistance using the above-identified toner formulation of the present invention.

In addition, the present invention relates to a method to reduce toner dust levels in a development system using the above-identified toner formulation of the present invention.

It is to be understood that both the foregoing general description and the following detailed description are exemplary and explanatory only and are intended to provide a further explanation of the present invention, as claimed.

DETAILED DESCRIPTION OF THE PRESENT INVENTION

The present invention relates to toner particles and toner formulations that contains at least one toner resin and at least one wax. In more detail, the wax can be a polyalkylene wax that is present in the toner formulations or toner particles of the present invention and has a wax molecular weight polydispersity of 2.0 or higher. Alternatively or in addition, the wax can have a percent crystallinity of 80% or more as measured by DSC. Preferably, the wax further has a number average molecular weight of about 2,000 or higher and/or a melting temperature onset of from about 115° C. to about 130° C. Preferably, the toner formulations of the present invention are free flowing and have acceptable toner ruboff properties.

The toner formulations of the present invention can be used in single component toners or two component toner systems. Preferably, the toner formulations of the present invention are used in two component toner/developer systems.

In the present invention, one or more toner resins are present in the toner particles or toner formulations of the present invention. The toner particles can be any conventional size and preferably have a median volume diameter of from about 6 microns or less to about 12 microns. The toner resin can be any conventional polymeric resin or combination of resins typically used in toner formulations using conventional amounts.

The toner particles can include one or more toner resins which can be optionally colored by one or more colorants by compounding the resin(s) with at least one colorant and any other ingredients. Although coloring is optional, normally a colorant is included and can be any of the materials mentioned in *Colour Index*, Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 85 to about 95.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 90% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acrylate monomers such as alkyl acrylate and alkyl methacrylate. Preferably, the toner resin is a cross-linked styrene-acrylic resin.

With respect to the polyalkylene wax, the polyalkylene wax can also serve the purpose as a suitable release agent. The polyalkylene wax, as indicated above, has a polydispersity of 2.0 or higher. Alternatively, the polyalkylene wax has a number average molecular weight of from about 2,000 or higher with any polydispersity number. More preferably, the polyalkylene wax that is present has a polydispersity of from 2.0 to about 10.0 and more preferably a polydispersity of from 3.0 to about 5.0. The polydispersity is a number representing the weight average molecular weight of the polyalkylene wax divided by the number average molecular weight of the polyalkylene wax.

Alternatively or in addition, a wax can be used that has a percent crystallinity of 80% or more as measured by DSC. Preferably, the percent crystallinity is 90 to 99%. The wax can be a polyalkylene wax or other types of waxes.

Furthermore, the wax preferably has a number average molecular weight of about 2,000 or higher and more preferably a number average molecular weight of from about 2,000 to about 7,000, and even more preferably a number average molecular weight of from about 2,000 to about 5,000.

In addition, the wax of the present invention preferably has a melting temperature onset of from about 115° C. to about 130° C. The melting temperature onset is calculated by identifying the temperature at which a melting transition is exhibited first in a Differential Scanning Calorimeter (DSC) scan by showing a departure from the baseline. DSC scans were obtained using a Perkin Elmer DSC 7. A toner weight of 10 to 20 mg was used at a heating and cooling rate of 10° C. per minute.

Preferably, the wax that is present in the toner formulations of the present invention has all four of the above-described properties or can have one, two, or three of the properties in any combination.

Examples of suitable polyalkylene waxes include, but are not limited to, polyethylene or polypropylene, such as Clariant Licowax PE130, Licowax PE190, Viscol 550 or 660 from Sanyo and the like.

The amount of the wax that is present in the toner formulations of the present invention can be any suitable amount to accomplish the benefits mentioned herein. Examples of suitable amounts include, but are not limited to, from about 0.1 to about 10 weight percent and more preferably from about 1 to about 6 weight percent based on the toner weight. Other suitable amounts are from about 1 part to about 5 parts based on a 100 parts by weight of the toner resin present. Though not necessary, other conventional waxes can be additionally present, such as other polyolefin waxes and the like.

The following discussion relates to optional components that can also be present in the toner particles or formulations of the present invention.

As indicated above, at least one charge control agent can be present in the toner formulations of the present invention. The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

Additional examples of suitable charge control agents include, but are not limited to, acidic organic charge control agents. Particular examples include, but are not limited to, 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoromethylphenyl)-3H-pyrazol-3-one and the corresponding zinc salts derived therefrom. Other examples include charge control agents with one or more acidic functional groups, such as fumaric acid, malic acid, adipic acid, terephathalic acid, salicylic acid, fumaric acid monoethyl ester, copolymers of styrene/methacrylic acid, copolymers of styrene and lithium salt of methacrylic acid, 5,5'-methylenedisalicylic acid, 3,5-di-t-butylbenzoic acid, 3,5-di-t -butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide.

Another class of charge control agents include, but are not limited to, iron organo metal complexes such as organo iron complexes. A particular example is T77 from Hodogaya.

Preferably, the charge control agent is capable of providing a consistent level of charge. For purposes of the present invention, a preferred consistent level of charge is from about −10 to about −30 micro C/gm. The toner Q/m ratio can be measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μC/g) is calculated by dividing the accumulated charge by the mass of the deposited toner taken from the upper plate. In order to correctly predict the effect of toner formulation on charge with developer life, a developer at 20 percent toner concentration is first prepared. The developer is then allowed to exercise in the presence of a development roller in which the core is rotating at 2000 rpm. After 1 hour of exercise, the developer is removed and the toner is separated from the carrier by exposing the developer to high voltage of opposite polarity to toner. The stripped carrier is then rebuild with fresh toner at 10 percent toner concentration. The developer is first wrist shaken for 2 minutes and "Fresh" charge is measured using the MECCA device. This developer is then placed on a magnetic roller where it is exercised for 10 minutes with magnetic core rotating at 200 rpm. The "Aged" charged is measured again using MECCA.

The charge control agent(s) is generally present in the toner formulation in an amount to provide a consistent level of charge and preferably provide a consistent level of charge of from about −10 to about −30 micro C/gm in the toner formulation upon being charged. Examples of suitable amounts include from about ½ part to about 6 parts per 100 parts of resin present in the toner formulation.

With respect to the surface treatment agent, also known as a spacing agent, the amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 1.5 weight percent, and more preferably from about 0.1 to about 1.0 weight percent, and most preferably from about 0.2 to 0.6 weight percent, based on the weight of the toner.

The spacing agent can be applied onto the surfaces of the toner particles by conventional surface treatment techniques such as, but not limited to, conventional powder mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the toner particles in order to achieve distribution on the surface of the toner particles, the mixture can be sieved to remove any agglomerated spacing agent or agglomerated toner particles. Other means to separate agglomerated particles can also be used for purposes of the present invention.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof. These metal oxide particles can be optionally treated with a silane or silicone coating to alter their hydrophobic character.

When the toner formulation of the present invention is used in a two-component toner, the carrier particles used in association with the toner formulation can be conventional carrier particles. Thus, the carrier particles can be hard or soft magnetic carrier particles.

In more detail, the set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and poly(vinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

When the toner formulation of the present invention is used in a single component toner system, the toner formulation has present charging particles as well, such as negatively charging particles. The amount of the charging particles for the single component optional system are conventional amounts. When a single component system is used, preferably the charging particles are at least one type of magnetic additive or material, such as soft iron oxide which is dispersed in the toner. Examples of useful charging particles include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB1120 from Magnox Inc.

The toner formulations of the present invention can also be used in magnetic image character recognition (MICR). In such an application, the amount of the magnetic material in the toner particles of the present invention can be any amount sufficient to preferably meet commercial needs, such as providing a sufficient signal strength for the toners developed as an image. Preferably, the amount of magnetic loading in the toner compositions is from about 40% to about 50% by weight of the toner particles, and more preferably from about 42% to about 45% by weight of the toner particles. The toner preferably comprises, based on the weight of the toner, from about 40 to about 60 wt % polymer; from about 30 to about 55 wt % magnetic additive or material; optionally from about 1 to about 5 wt % release agent; and the preferred concentrations of silicon dioxide described above, all based on the weight of the toner.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

Developers in the development system of the present invention are preferably capable of delivering toner to a charged image at high rates and hence are particularly suited to high-volume electrophotographic printing applications and copying applications.

The present invention further relates to a method to improve toner image abrasion resistance. In this method, a sufficient amount of the above-described wax (e.g., polyalkylene and/or high crystallinity wax) is introduced or included in the toner particles or toner formulations. Any amount capable of improving the toner image abrasion resistance as compared to when no wax is present can be used such as amounts ranging from 0.1 weight percent to 10 weight percent, based on toner weight or amounts from about 1 part to about 5 parts based on a 100 parts by weight of the toner resin present. The toner image abrasion resistance can be improved by at least 10% as compared to a control having no wax and more preferably by at least 50% and even more preferably by at least 100%.

An additional embodiment of the present invention is a method to control or reduce toner "dust" levels in a development system. A fraction of toner that does not reach sufficient level of tribocharge, is often thrown out from a rotating core and shell development roller when the electrostatic force is lower than the opposing centrifugal force. The is referred to as "dust" and can be measured by taking a 2 grams of a 10 percent toner concentration developer to which 0.12 grams of additional toner has been added and the mixture is then gently wrist shaken for 15 seconds. This developer is then placed on a roller where the core of alternating 12 magnets is rotated at 2000 rpm under a stationary shell. The core is turned on for two minutes and the amount of toner, in milligrams, which is collected away from the roller is measured and reported as dust. In the present invention, the dust levels can be controlled or reduced by incorporating or including a wax as described above into the toner particles or formulations. Generally, the amount of the wax used is in amounts sufficient to decrease dust levels in a development system. Typical amounts are from 0.1 weight percent to 10 weight percent, based on toner weight or amounts from about 1 part to about 5 parts by weight based on a 100 parts by weight toner resin. The dust levels can be reduced, compared to a control having no wax, on the order of at least 50% more preferably reduced by at least 80% in a development system.

The present invention can be further clarified by the following examples, which are intended to be purely exemplary of the present invention.

EXAMPLES

Example 1

A toner formulation was made from the following components:

TABLE I

| Chemical | Trade name | Manufacturer | Weight % |
|---|---|---|---|
| Crosslinked styrene butyl acrylate copolymer | SB77XL | Eastman Kodak | 90.09 |
| Carbon Black | Black Pearls 430 | Cabot Corp | 6.3 |
| Polyethylene wax | See Tables 2–4 | Clariant or Baker Petrolite | 1.8 |

TABLE I-continued

| Chemical | Trade name | Manufacturer | Weight % |
|---|---|---|---|
| Iron organic chelate charge control agent | T77 | Hodogaya | 1.8 |

The components were dry powder blended in a 40 liter Henschel mixer for 60 seconds at 1000 RPM to produce a homogeneous blend. The powder blend was then melt compounded in a twin screw co-rotating extruder to melt the polymer binder and disperse the pigments, charge agents, and waxes. Melt compounding was done at a temperature of 230° F. at the extruder inlet, 230° F. increasing to 385° F. in the extruder compounding zones, and 385° F. at the extruder die outlet. The processing conditions were a powder blend feed rate of 10 kg/hr and an extruder screw speed of 490 RPM. The cooled extrudate was then chopped to approximately ⅛ inch size granules.

After melt compounding, the granules were then fine ground in an air jet mill to a particle size of 11 micron median, volume weighted, diameter. The toner particle size distribution was measured with a Coulter Counter Multisizer. The fine ground toner was then classified in a centrifugal air classifier to remove very small toner particles and toner fines that were not desired in the finished toner. After classification to remove fine particles, the toner had a particle size distribution with a width, expressed as the diameter at the 50% percentile/diameter at the 16% percentile of the cumulative particle number versus particle diameter, of 1.30 to 1.35.

The classified toner was then surface treated with fumed silica. A hyrdophobic silica, designated R972, and manufactured by Nippon Aerosil was used. 2000 grams of toner were mixed with 10 grams of silica to give a product containing 0.5 weight percent silica. The toner and silica were mixed in a 10 liter Henschel mixer with a 4 element impeller for 2 minutes at 2000 RPM. The silica surface treated toner was sieved through a 230 mesh vibratory sieve to remove un-dispersed silica agglomerates and any toner flakes that may have formed during the surface treatment process.

TABLE 2

| Styrene acrylic toner with polyethylene wax Wax Type | Wax Number Average Molecular Weight | Toner Image Abrasion Resistance, cumulative ruboff metric, |
|---|---|---|
| Polywax 500 | 500 | 25 |
| Polywax 1000 | 1000 | 20 |
| Polywax 2000 | 2000 | 17 |
| Polywax 3000 | 3000 | 14 |
| Clariant Licowax PE130 | 2120 | 13 |
| control, no wax | not applicable | 33 |

TABLE 3

| Styrene acrylic toner with polyethylene wax Wax Type | Number Average Molecular Weight | Wax Molecular Weight Polydispersity | Toner Charge to mass measured with fresh developer, uC/gm | Toner Charge to mass measured with aged developer, uC/gm |
|---|---|---|---|---|
| Polywax 2000 | 2160 | 1.6 | −28.1 | −47.9 |
| Clariant Licowax PE130 | 2120 | 4.6 | −24.6 | −35.5 |
| Clairant Licowax PE190 | 4900 | 3.7 | −24 | −37 |
| None | not applicable | not applicable | −21.0 | −36.9 |

TABLE 4

| Styrene acrylic toner with polyethylene wax Wax Type | Wax Melt Temperature Onset | Toner two roll melt Compounding temperature | Wax Molecular Weight | Toner Admix "dust" Level, grams |
|---|---|---|---|---|
| Polywax 500 | 52.5 C. | 150 C. | 500 | 46.5 |
| Polywax 1000 | 65.1 C. | 150 C. | 1000 | 28.3 |
| Polywax 2000 | 117.7 C. | 150 C. | 2000 | 31.6 |
| Polywax 3000 | 118.4 C. | 150 C. | 3000 | 24.2 |
| Clariant Licowax PE130 | 121.0 C. | 150 C. | 2120 | 16.9 |
| Clariant Licowax PE190 | 118.7 C. | 150 C. | 4900 | 9.1 |
| Control, no wax | not applicable | not applicable | not applicable | 23.8 |

TABLE 5

| | |
|---|---|
| Crosslinked styrene acrylic copolymer binder | 100 parts by weight |
| Carbon black | 5 to 9 parts by weight |
| negative charge control agent | 1 to 3 parts by weight |
| polyethylene wax | 1 to 5 parts by weight |

In the above-described example as shown through the tables, various toner formulations were prepared with different polyethylene waxes and also a control was prepared which contained no wax. The toners prepared as shown by the formulations set forth in Table 1 and Table 2, were then used in a Heidelberg Digimaster printer or a prototype LTD device. The images resulting from this printing test were then subjected to a toner image abrasion resistance test. The amount of rub-off or abrasion was measured by first preparing an image on 60 g/m$^2$ uncoated paper of uniform density. The toner laydown on paper was kept at 1 mg/cm$^2$. The image was fused in a fuser assembly similar to that used in a Heidelberg Digimaster printer. The image was kept in contact with a fresh sheet of paper for 24 hours. The image was then removed and placed faced up and another fresh sheet of paper was placed over it. A load of 30 kPa was then applied over the two sheets of paper. With the load in place, the fresh sheet was pulled away at 0.2 m/s. The marking on the fresh paper left by the imaged sheet was measured by measuring the transmission density of the image using a X-rite photographic densitometer. Status A density was measured in 7 different spots and the process was repeated again on another set of image. All the densities were then added and the resulting number was then multiplied by 10 to provide the "cumulative ruboff metric" reported in Table 2.

The lower the number for abrasion resistance means that the toner image has better abrasion resistance. In other words, a higher number reflects a large ruboff of the toner image which is not desirable. As seen in Table 2, an image resulting from a toner containing no wax had a very poor toner image abrasion resistance as reflected by the high abrasion resistance number. Furthermore, toners containing polyethylene waxes with a low number average molecular weight also had a poor abrasion resistance. Unexpectedly, images prepared from toners containing polyethylene waxes having a number average molecular weight of 2,000 or greater had a significantly better abrasion resistance.

Furthermore, as shown in Table 3, when toners were prepared from polyethylene waxes having a high number average molecular weight as well as a high polydispersity, the charge stability over time for toner charge was greatly improved when a polydispersity number was greater than 2.

In addition, as shown in Table 4, toners containing polyethylene wax having a high number average molecular weight and also a wax melt temperature onset of greater than 115° C. provided generally lower dust levels in a development system which produces or minimizes image background on a toner image and further reduces machine contamination.

Table 5 reflects an example of formulations that can be used for purposes of the present invention. Other resins and optional ingredients can be used as well as well as different amounts as indicated above.

The toner formulations of the present invention add a consistent level of charge with excellent ruboff properties and excellent flowability. Accordingly, a balance of properties was achieved with the toner formulations of the present invention.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

The invention claimed is:

1. Toner particles comprising at least one resin and wax, wherein said wax is a polyalkylene wax having a polydispersity of 2.0 or higher and having a percent crystallinity of 80% or more as measured by DSC, wherein said resin is a preformed polymer, and wherein said wax has a number average molecular weight of about 2,000 or above.

2. The toner particles of claim 1, wherein said wax has a melting temperature onset of from about 115° C. to about 130° C.

3. The toner particles of claim 1, wherein said toner particles are negatively charging toner particles.

4. The toner particles of claim 1, wherein said toner resin comprises cross-linked styrene acrylic resin.

5. The toner particles of claim 1, wherein said polydispersity is from 2.0 to about 10.

6. The toner particles of claim 1, wherein said polydispersity is from 2.0 to about 5.0.

7. The toner particles of claim 1, wherein said number average molecular weight is from about 2,000 to about 7,000.

8. The toner particles of claim 1, wherein said number average molecular weight is from about 2,000 to about 5,000.

9. The toner particles of claim 1, further comprising at least one surface treatment agent, at least one charge control agent, at least one colorant, or combinations thereof.

10. The toner particles of claim 9, wherein said surface treatment agent comprises silica.

11. The toner particles of claim 9, wherein said surface treatment agent comprise at least one metal oxide.

12. The toner particles of claim 1, further comprising at least one negative charge control agent.

13. The toner particles of claim 1, wherein said toner particles have a median volume diameter of from about 6 to about 12 microns.

14. A method for developing an electrostatic image comprising developing an electrostatic image member bearing an electrostatic image pattern by moving the image member through a development zone and transporting developer through the development zone, said developer comprising charged toner particles of claim 1 and oppositely charged hard magnetic carrier particles, in developing relation with the electrostatic image pattern of the moving imaging member by rotating an alternating-pole magnetic core of a pre-selected magnetic field strength within an outer non-magnetic shell, which is rotating or stationary, and controlling the directions and speeds of the core and optionally the shell rotations so that developer flows through the development zone in a direction co-current with the image member movement, transferring said charged toner particles to said electrostatic image pattern to form a toner image, transferring said toner image onto a substrate and fusing said toner image on said substrate by passing the substrate through a fuser roll having an elastomer or resin coating on the core of the fuser roll.

* * * * *